United States Patent [19]

Foster

[11] Patent Number: 4,512,501

[45] Date of Patent: Apr. 23, 1985

[54] DOWN-LOCKING DISPENSING PUMP WITH GUIDED CHECK VALVE HOLD-DOWN STRUCTURE

[76] Inventor: Donald D. Foster, R.R. 1, Box 306A, Kingsville, Mo. 64051

[21] Appl. No.: 410,459

[22] Filed: Aug. 23, 1982

[51] Int. Cl.[3] ..... B65D 47/34

[52] U.S. Cl. ..... 222/153; 222/321

[58] Field of Search ..... 222/153, 321, 384, 402.11; 239/333

[56] References Cited

U.S. PATENT DOCUMENTS

| | | | |
|---|---|---|---|
| 2,956,509 | 10/1960 | Cooprider et al. | 222/384 |
| 4,369,899 | 1/1983 | Magers et al. | 222/384 |
| 4,375,266 | 3/1983 | Magers et al. | 222/384 |

*Primary Examiner*—H. Grant Skaggs

[57] ABSTRACT

When the reciprocable plunger of the pump is locked down in its fully depressed position, the lowermost tip of the plunger maintains the inlet ball check valve of the pump forcefully pressed against its seat to prevent leakage. Spindly legs on the hollow plunger adjacent the tip thereof define inlet orifices for the discharge passage of the plunger during operation and provide a spring-like action for generating the ball hold down force. As the tip engages the ball valve and the plunger is rotated slightly during the lock down, the lowermost cylindrical portion of the plunger is centered on the ball and held against rotation by the resilient legs and a trio of guiding projections arranged in the lower end of the pump chamber about the cylindrical portion. Consequently, the legs have a tendency to wind up torsionally as well as bow resiliently outwardly to thereby compound the resistance of the plunger to unseating movement by the ball.

4 Claims, 4 Drawing Figures

DOWN-LOCKING DISPENSING PUMP WITH GUIDED CHECK VALVE HOLD-DOWN STRUCTURE

TECHNICAL FIELD

This invention relates to the field of hand-operated dispensing pumps of the type which are designed for releasable lock down of their reciprocable plungers and, more particularly, to improvements which promote effective sealing of the inlet at the lower end of the pump chamber of such devices when the plungers are in their down and locked positions.

BACKGROUND ART

A locked down pump is illustrated in copending application Ser. No. 207,893 filed Nov. 18, 1980 and assigned to the assignee of the present invention now U.S. Pat. No. 4,375,266. The plunger of that pump has a lowermost tip which engages and presses against the inlet ball valve when the plunger is fully locked down, and a series of axially extending, spindly legs forming a part of the plunger tip serve to define a set of orifices for introducing product into the plunger and to provide a spring-like action for sealingly seating the ball and taking up any excess length of the plunger relative to the pump body.

SUMMARY OF THE PRESENT INVENTION

The present invention is directed to an extension and further refinement of the principles set forth in said co-pending application. In this regard, the present invention contemplates having the tip portion of the plunger cooperate with a circumferential series of guiding projections at the lower end of the pump chamber which receive and center the tip as it approaches the ball check valve. The tip is confined by the projections as it engages the ball, even as the plunger is then rotated slightly to secure the hold-down lock in place. Thus, the thin, orifice-defining legs on the plunger have a tendency to become slightly wound up in a torsional manner as they are also bowed slightly outwardly. This compounds the resistance of the tip to unseating movement by the ball valve to thereby more reliably prevent leakage during shipment, handling and storage.

DETAILED DESCRIPTION

Figure 1:
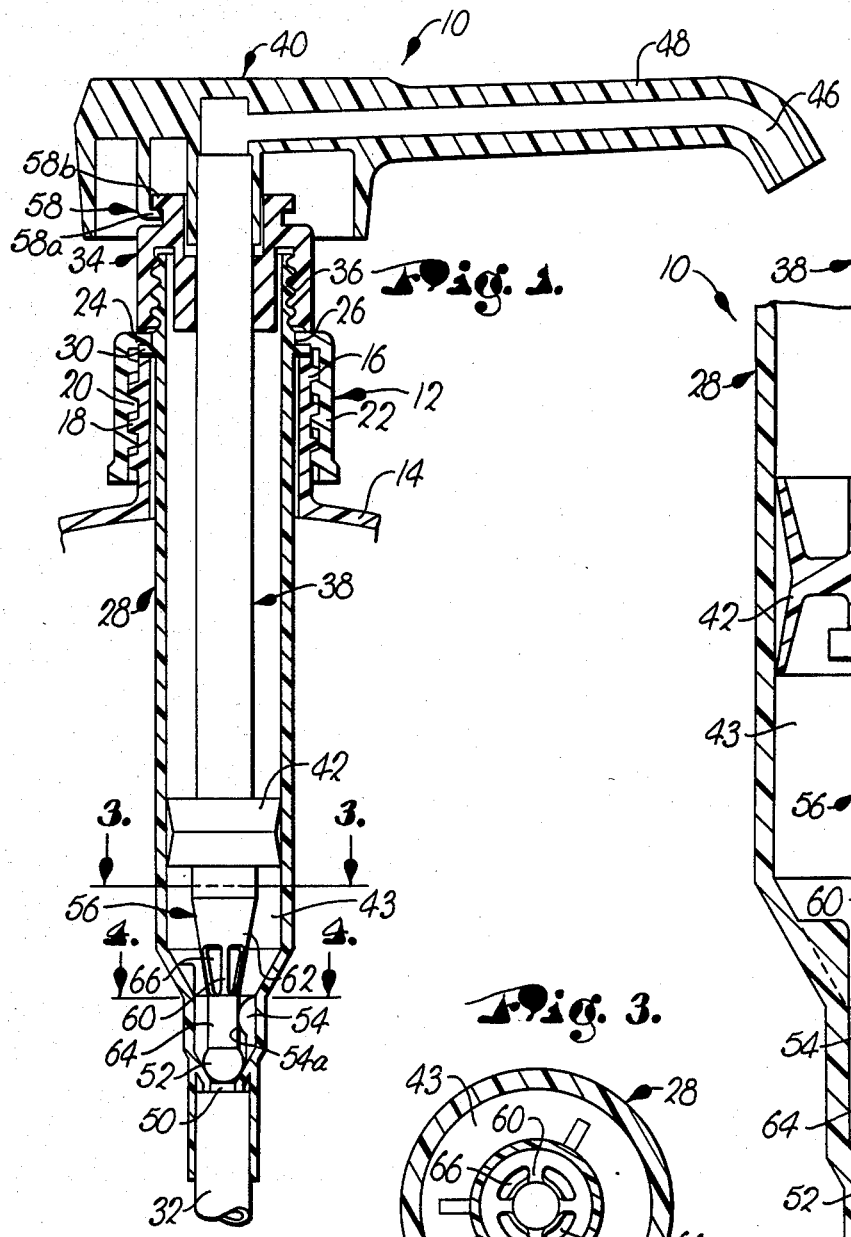
FIG. 1 is a fragmentary, vertical cross-sectional view of a pump constructed in accordance with the present invention and installed upon a suitable container, the plunger being illustrated in a fully down and locked position.

The pump 10 is installed upon the closure 12 of a container 14 having a neck finish 16 in the nature of external threads 18 which mate with internal threads 20 of the closure 12 formed on the annular sidewall 22 thereof. The top wall 24 of the closure 12 is provided with a centrally disposed opening 26 through which the tubular body 28 of the pump projects. An external, annular flange 30 on the body 28 rests upon the top edge of the neck finish 16 in order to suspend the lower portion of the body 28 and the dip tube 32 down into the interior of the container 14.

In addition to the body 28, the pump 10 further includes an annular collar 34 snapped onto the upper end of the body 28 via interfitting beads and grooves denoted broadly by the numeral 36. The collar 34 serves to attach the pump 10 to the closure 12 such that the closure 12 and the pump 10 together form an assembly which can be threaded onto and off of the container 14 as desired.

The collar 34 is located in axial registration with the body 28 and functions further to provide a bearing surface for the reciprocable plunger 38 of the pump 10 having an operating head 40 at its upper end which may be manually depressed and raised in order to reciprocate the plunger 38 and operate the pump 10. A piston seal 42 adjacent the lower end of the plunger 38 makes sealing contact with the interior surface of the body 28 for the purpose of drawing products into the chamber 43 of body 28 below said piston seal 42 during an upstroke of the plunger 38, and for pumping such products out of the chamber 43 via a passage 44 in the plunger 38 during a downstroke of the latter. From the passage 44, the products flow to an outlet 46 in the spout 48 of the head 40.

The pump 10 further includes an inlet 50 at the lower end of the body 28 communicating the dip tube 32 with the interior of the body 28. Inlet 50 is controlled by a ball check valve 52 which seats against the inlet 50 to close the latter during a downstroke of the plunger 38 and which rises off the inlet 50 to open the latter during an upstroke of the plunger 38. Upward movement of the ball valve 52 is limited by a trio of inwardly protruding projections 54 on the body 28 a short distance above the ball 52. A second valve (not shown) is typically located within the plunger 38 adjacent the head 40 for the purpose of closing the passage 44 during upstroke of the plunger 38 and opening the passage 44 during a downstroke of the plunger 38.

Figure 2:
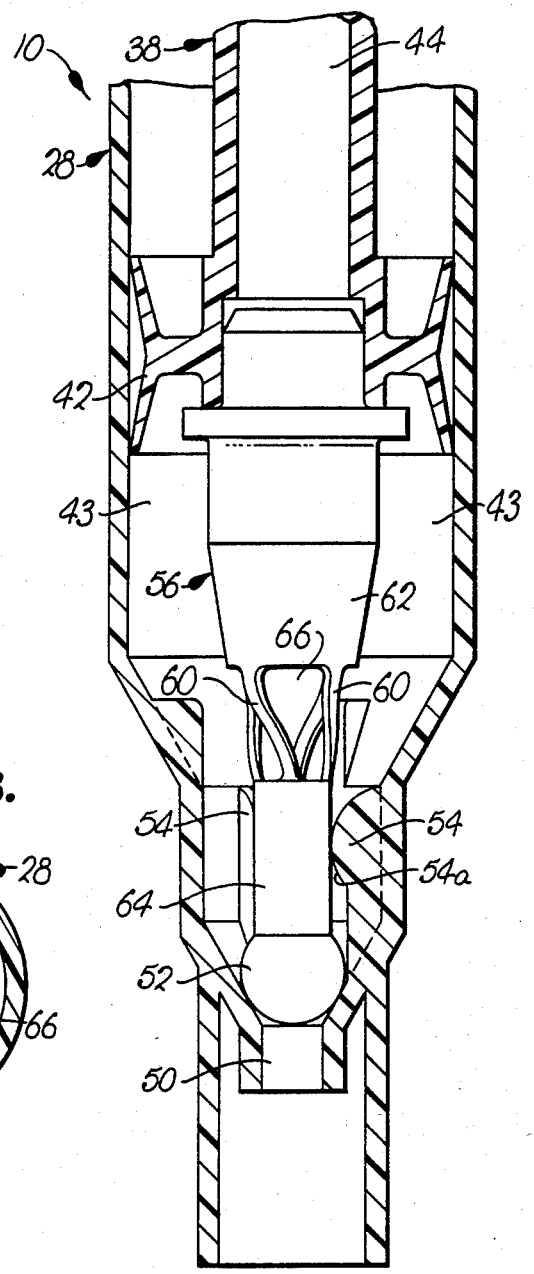
FIG. 2 is an enlarged, fragmentary, vertical cross-sectional view thereof illustrating the manner in which the thin legs become bowed and placed in torsion when the plunger is locked down.
Figure 3:
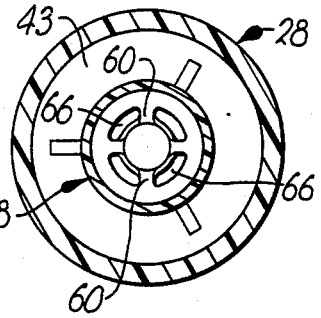
FIG. 3 is a transverse cross-sectional view of the pump taken substantially along line 3—3 of FIG. 1.
Figure 4:
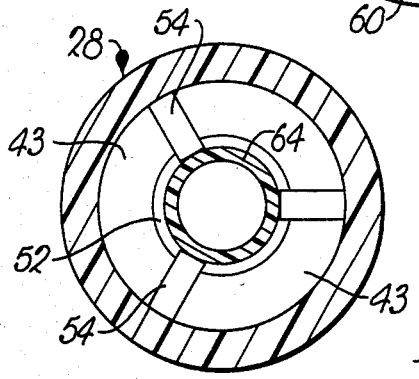
FIG. 4 is a transverse cross-sectional view taken substantially along line 4—4 of FIG. 1.

The plunger 38 is provided with a hollow lowermost tip 56 for holding down the ball check valve 52 at such time as the plunger 38 is in a fully depressed position as illustrated in FIGS. 1 and 2. Releasable locking means 58 of any suitable kind between the head 40 and the collar 34 may be provided to hold the plunger 38 locked down. Preferably, the locking means 58 is a bayonet-type lock which is engaged by fully depressing the plunger 38 and then rotating the same slightly to bring a lug **58*a* under a retaining ledge 58*b***.

The tip 56 is provided with a series of axially extending, spindly legs 60 situated in a downwardly tapering portion 62 just above an axially extending, cylindrical portion 64. The legs 60 are straight, unbowed and untwisted in their natural, unloaded state and comprise integrally molded portions of the tip 56, the latter preferably being constructed from a suitable polyolefin material such as polypropylene. The spaces between the legs 60 serve to define inlet orifices 66 communicating the chamber 43 with the interior passage 44 of the plunger 38. Projections 54 have arcuate, convex outermost surfaces **54*a* facing into the chamber 43 in closely confining relationship with the cylindrical portion 64. As shown, the cylindrical portion 64 of the tip 56 is smaller in diameter than the ball 52 such that, by having the surfaces 54***a* of projections 54 disposed closely adjacent if not in contacting relationship with the cylindrical portion 64 when the plunger 38 is locked down, the projections 54 will necessarily serve not only to confine and guide the cylindrical portion 64 but also to overlie the ball 52 and limit upward movement thereof as it opens the inlet 50.

OPERATION

As is readily apparent to those skilled in the art, reciprocation of the plunger 38 causes products to be alternately drawn up into the chamber 43 and forced out of the spout 48. When it is desired to lock the plunger 38 for initial shipping, subsequent handling or storage, the plunger 38 is moved to a fully depressed condition and then rotated slightly to bring the lug 58*a* under the over-hanging ledge 58*b*. This prevents extension of the plunger 38 unless the latter is first rotated in the reverse direction to release the lug 58*a* from under the ledge 58*b*.

As the plunger 38 is fully depressed to engage the lock 58, the cylindrical portion 64 of tip 56 is received between the guide projections 54 and comes into engagement with the ball 52. At this point, depending upon the length of the body 28 compared to that of the plunger 38, the thin legs 60 will bow outwardly to a slight extent in order to take up the excess length of the plunger 38. This also produces a compressive force against the ball 52 to seat the latter firmly in place.

As the plunger 38 is then rotated to engage the lock 58, the compressive force of the tip 56 against the ball 52 tends to keep the cylindrical portion 64 stationary as the tapered portion 62 rotates with the remainder of the plunger 38. Consequently, the legs 60 become twisted slightly or wound up in a torisional manner such as shown in FIG. 2. Therefore, any attempted unseating movement of the ball 52 is resisted not only by the legs 60 in an axial sense as they seek resiliently to return to their unbowed conditions, but also by the legs 60 in a rotational or torsional sense. Because the legs 60 are slightly preloaded in a torsional sense, attempted upward movement of the cylindrical portion 64 results in the legs 60 being further twisted, and that action is resisted by the legs 60 as they attempt to return to a untwisted condition. Note that without the slight pre-twisting of the legs 60, attempted upward axial movement of the cylindrical portion 64 would only tend to further bow the legs 60 perhaps to such an extent as to exceed their elastic limits, whereupon all effective hold down force by the plunger 38 against the ball 52 would be lost.

It is important to bear in mind that the ball 52 is frequently subjected to fluid pressure on its underside from the contents of the container 14. For example, during shipment contents may be subjected to relatively high temperatures, causing any gases within the container 14 to expand and press upwardly against the ball 52 through the dip tube 32 and the inlet 50. Consequently, the legs 60 must be adequate to not only hold the ball 52 firmly seated during initial assembly and filling of the container 14 but also during subsequent periods when internal pressures attempt to force the ball 52 off its seat. Under those circumstances, the compounded resistance to upward movement of the cylindrical portion 64 provided by the twist in legs 60 as well as their outward bow is especially beneficial.

It is to be noted further than the confining action of the projections 54 prevents any deviant action by the cylindrical portion 64 at the time the tip 56 is torsionally loaded by rotating plunger 64 to engage the lock 58. By keeping the cylindrical portion 64 centered on the ball 52 at such times, there is greater assurance that the tip 56 will in fact become torsionally loaded in the intended manner. Moreover, during subsequent attempts by the ball 52 to rise off its seat, having the cylindrical portion 64 properly centered at those times helps assure that such attempted movement will be transmitted to the legs 60 in the proper manner and resisted to the greatest available extent. If the cylindrical portion 64 were cocked off center, an axial, upward force from the ball 52 would tend to only cock the portion 64 further, in the absence of the projections 54, which would manifestly provide significantly less resistence to the ball 52 than desired.

Due to the convexly arcuate nature of the surfaces 54*a* of projections 54, there is only point contact on the cylindrical portion 64 by the projections 54. Consequently, support for the cylindrical portion 64 as it approaches the ball 52 is quite stable. Likewise, once the legs 60 are bowed outwardly and wound up to the desired extent, confining support by the projections 54 is likewise quite stable.

I claim:

1. In a dispensing pump, the improvement comprising:

a tubular body having a collar at one end thereof and an inlet at the opposite end thereof;

a tubular projecting through said collar and reciprocable within said body between depressed and extended positions;

a check valve operably associated with said inlet for opening and closing the same, said valve opening the inlet during movement of the plunger toward said extended position for drawing products into the body through said inlet and closing the inlet during movement of the plunger toward said depressed position for forcing products out of the body through said plunger;

locking means associated with said collar for selectively, releasably locking the plunger in said fully depressed position;

an elongated, lowermost tip on said plunger disposed for engaging said valve and holding the same in its position closing said inlet when the plunger is locked by said locking means in said fully depressed position;

orifice means in said plunger communicating the interior of the latter with the interior of said body for discharging products through the plunger upon depression of the latter, said orifice means including a series of axially elongated orifices spaced around said tip and separated by a plurality of elongated, yieldably resilient legs; and guide means in said body disposed to cooperate with said plunger tip in maintaining the same engaged with said valve when the plunger is locked in said fully depressed position, said locking means including structure lockingly engageable to retain the plunger in its fully depressed position upon slight rotation of the plunger relative to the collar when the plunger is fully depressed with said tip engaging the valve and said guide means engaging said tip for resisting rotation thereof with the remainder of the plunger, whereby to torsionally load said legs.

2. In a dispensing pump as claimed in claim 1, wherein said tip includes an axially extending cylindrical portion, said guide means including a plurality of circumferentially spaced projections alongside the path of travel of said cylindrical portion confining the latter when the plunger is in said fully depressed position.

3. In a dispensing pump as claimed in claim 2, wherein said valve includes a ball, said projections being spaced above said ball when the valve is closed and defining an upper limit of travel for the ball when the valve is opened.

4. In a dispensing pump as claimed in claim 3, wherein said projections are each provided with a convex, tip-confining surface.

* * * * *

UNITED STATES PATENT AND TRADEMARK OFFICE

CERTIFICATE OF CORRECTION

PATENT NO. : 4,512,501

DATED : April 23, 1985

INVENTOR(S) : Donald D. Foster

It is certified that error appears in the above-identified patent and that said Letters Patent is hereby corrected as shown below:

On the face page of the patent, following identification of the inventor, insert:

[73] Assignee: Realex Corporation, Kansas City, Mo.

Signed and Sealed this

*First* Day of *October 1985*

[SEAL]

*Attest:*

DONALD J. QUIGG

*Attesting Officer*

*Commissioner of Patents and Trademarks—Designate*